US011329400B2

(12) United States Patent
Mezrioui et al.

(10) Patent No.: US 11,329,400 B2
(45) Date of Patent: May 10, 2022

(54) MULTIPLE-PIECE FEMALE ELECTRICAL TERMINAL

(71) Applicant: Lear Corporation, Southfield, MI (US)

(72) Inventors: Sami Mezrioui, Remscheid (DE); Sven Vesper, Remscheid (DE); Oriol Soldevila, Remscheid (DE)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 17/018,482

(22) Filed: Sep. 11, 2020

(65) Prior Publication Data

US 2021/0159616 A1 May 27, 2021

(30) Foreign Application Priority Data

Nov. 22, 2019 (DE) ..... 102019218072.8

(51) Int. Cl.
*H01R 4/20* (2006.01)
*H01R 13/58* (2006.01)
*H01R 13/187* (2006.01)

(52) U.S. Cl.
CPC ..... *H01R 4/20* (2013.01); *H01R 13/187* (2013.01); *H01R 13/5808* (2013.01)

(58) Field of Classification Search
None
See application file for complete search history.

(56) References Cited

U.S. PATENT DOCUMENTS 5,271,741 A 12/1993 Saito et al.
5,810,627 A 9/1998 Gierut et al.
6,755,697 B2 6/2004 Kojima et al.
6,866,551 B2 3/2005 Murakami et al.
7,014,515 B2 3/2006 Lutsch et al.
7,252,559 B1 8/2007 Morello et al.
7,442,097 B2 10/2008 Kumakura
7,537,497 B2 5/2009 Tyler
7,556,541 B2 7/2009 Tyler
7,976,353 B2 7/2011 Myer et al.
8,104,173 B2 1/2012 Heacox et al.
8,858,274 B2 10/2014 Jakoplic et al.
9,118,131 B2 8/2015 Kakoplic et al.
(Continued)

FOREIGN PATENT DOCUMENTS

EP 0711009 A2 5/1996
EP 1643598 A1 4/2006
(Continued)

*Primary Examiner* — Ross N Gushi

(74) *Attorney, Agent, or Firm* — MacMillan, Sobanski & Todd, LLC

(57) ABSTRACT

The female electrical terminal includes an attachment piece. The attachment piece has a terminal body that is located around a terminal axis and defines an interior space. The terminal body has one or more flanges located on opposed sides of the terminal axis. The terminal body also has one or more body stops located on opposed sides of the terminal axis. The female electrical terminal also includes a contact piece. The contact piece has a contact body located around the terminal axis. A plurality of contact arms extend from the contact body at least partially in the interior space. The contact body is located at least partially between the flanges and the terminal axis. The contact piece also includes contact stops engaged with the body stops.

20 Claims, 4 Drawing Sheets

(56) References Cited

U.S. PATENT DOCUMENTS

| | | | | |
|---|---|---|---|---|
| 9,153,879 | B2 | 10/2015 | Frimmersdorf et al. | |
| 9,236,675 | B2 | 1/2016 | Tsuji et al. | |
| 9,455,514 | B2 * | 9/2016 | Hirakawa ..... | H01R 13/193 |
| 9,455,516 | B2 * | 9/2016 | Gutenschwager ... | H01R 13/187 |
| 9,601,854 | B2 | 3/2017 | Kutsuna et al. | |
| 9,812,806 | B2 | 11/2017 | Uezono | |
| 10,396,519 | B2 | 8/2019 | Busies et al. | |
| 2018/0151997 | A1 | 5/2018 | Busies et al. | |
| 2019/0013594 | A1 | 1/2019 | Kitamura et al. | |

FOREIGN PATENT DOCUMENTS

| | | | |
|---|---|---|---|
| EP | 1643598 | B1 | 9/2007 |
| EP | 2544309 | B1 | 10/2014 |
| WO | 2013125261 | A1 | 8/2013 |
| WO | 2014127817 | A1 | 8/2014 |
| WO | 2014127818 | A1 | 8/2014 |
| WO | 2014127819 | A1 | 8/2014 |

* cited by examiner

MULTIPLE-PIECE FEMALE ELECTRICAL TERMINAL

BACKGROUND OF THE INVENTION

This invention relates in general to multiple-piece female electrical terminals. In particular, this invention relates to an improved structure for a two-piece female electrical terminal that includes features to simplify assembly thereof.

A two-piece female electrical terminal is typically made of two different materials having different desired properties. This allows a first portion of the female terminal that is attached to a wire have a first set of properties and a second portion of the female terminal that contacts a corresponding male terminal to have a second set of properties. The different materials used to form the two parts of the female terminal may be selected for their respective desired properties, such as electrical conductivity, stability when exposed to various temperatures, durability, cost, weight, and the like.

In order to produce the two-piece female electrical terminal, the two pieces are made separately and are then assembled together. It is desirable that the two pieces be positioned properly relative to each other during assembly. This can be difficult when the two pieces are physically small, such as having widths measured in millimeters or less than a millimeter. A small misalignment between the two pieces during assembly can render the assembled component defective. Thus, it would be advantageous to have an improved structure for a two-piece female electrical terminal that includes features to simplify assembly thereof.

SUMMARY OF THE INVENTION

The invention relates to a female electrical terminal. The female electrical terminal includes an attachment piece. The attachment piece has a terminal body that defines a terminal axis and an interior space. The terminal body has one or more flanges located on opposed sides of the terminal axis. The terminal body also has one or more body stops. The female electrical terminal also includes a contact piece. The contact piece has a contact body located around the terminal axis. A plurality of contact arms extend from the contact body at least partially into the interior space. The contact body is located at least partially between the flanges and the terminal axis. The contact piece also includes contact stops that are engaged with the body stops.

In another embodiment, the terminal body includes a first body side and a second body side located on opposite sides of a terminal axis. The terminal body also includes a third body side and a fourth body side located on opposite sides of the terminal axis. The third body side and the fourth body side are connected to the first body side and the second body side. The terminal body includes flanges that extend from the first body side. The terminal body also includes flanges that extend from the second body side. Body stops are located on the third body side and the fourth body side. The contact body includes a first contact side located adjacent to the flanges that extend from the first body side. The contact body also includes a second contact side located adjacent to the flanges that extend from the second body side. A third contact side and a fourth contact side are connected to the first contact side and the second contact side. The third contact side and the fourth contact side include contact stops engaged with the body stops.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
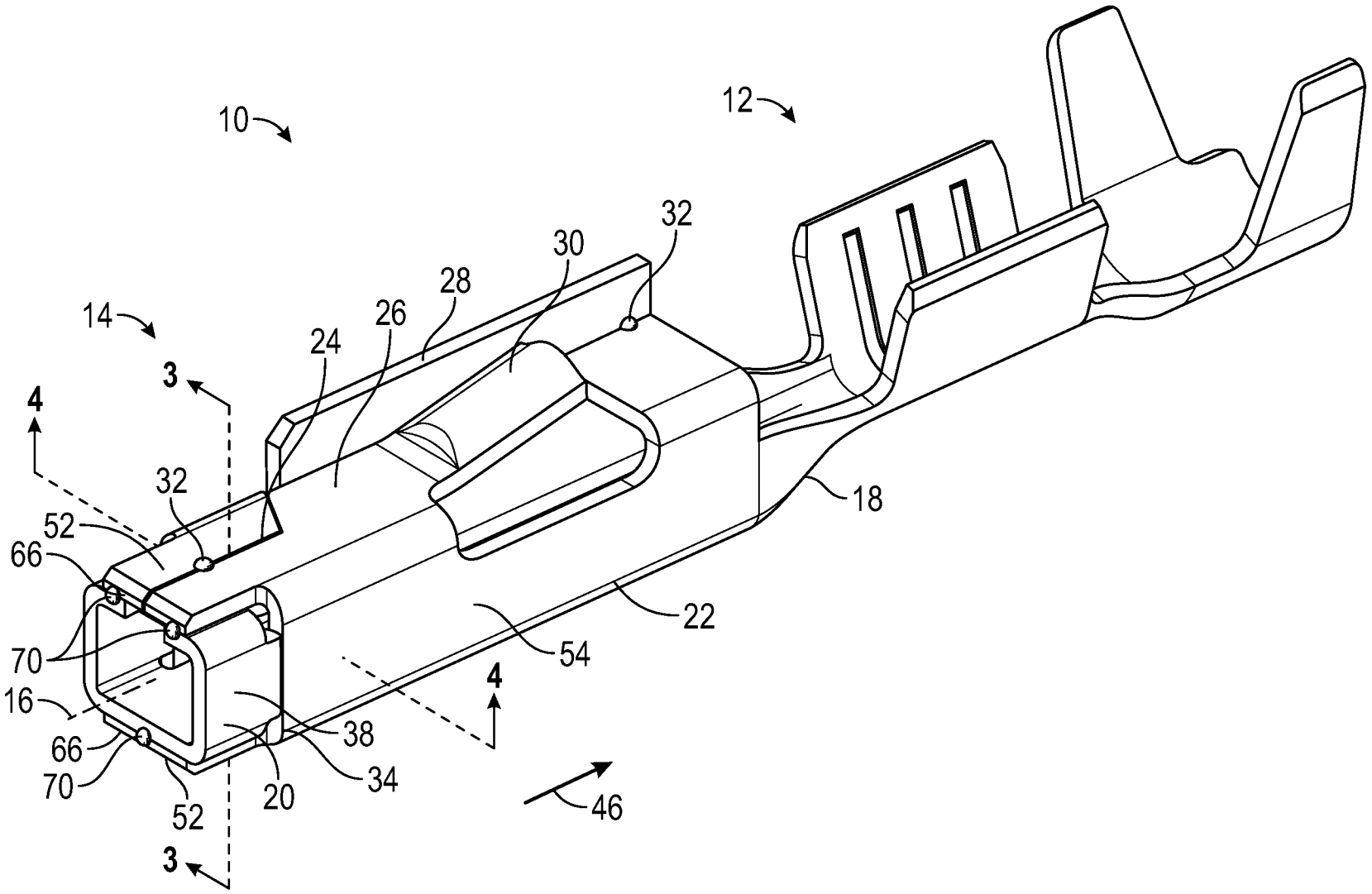
FIG. 1 is perspective view of a female electrical terminal in accordance with the invention.

Referring now to the drawings, there is illustrated in FIG. 1 a female electrical terminal, indicated generally at 10, in accordance with this invention. The female electrical terminal 10 includes a connection portion 12 that is adapted to engage a wire (not shown). The illustrated connection portion 12 is a crimp connection, but may be any desired type of connection. The female electrical terminal 10 also includes a contact portion, indicated at 14, that is adapted to engage a corresponding male connector (not shown). The illustrated female electrical terminal 10 is adapted to engage a pin-type male connector inserted along a terminal axis 16, but the corresponding connector may be any desired type of connector.

Figure 2:
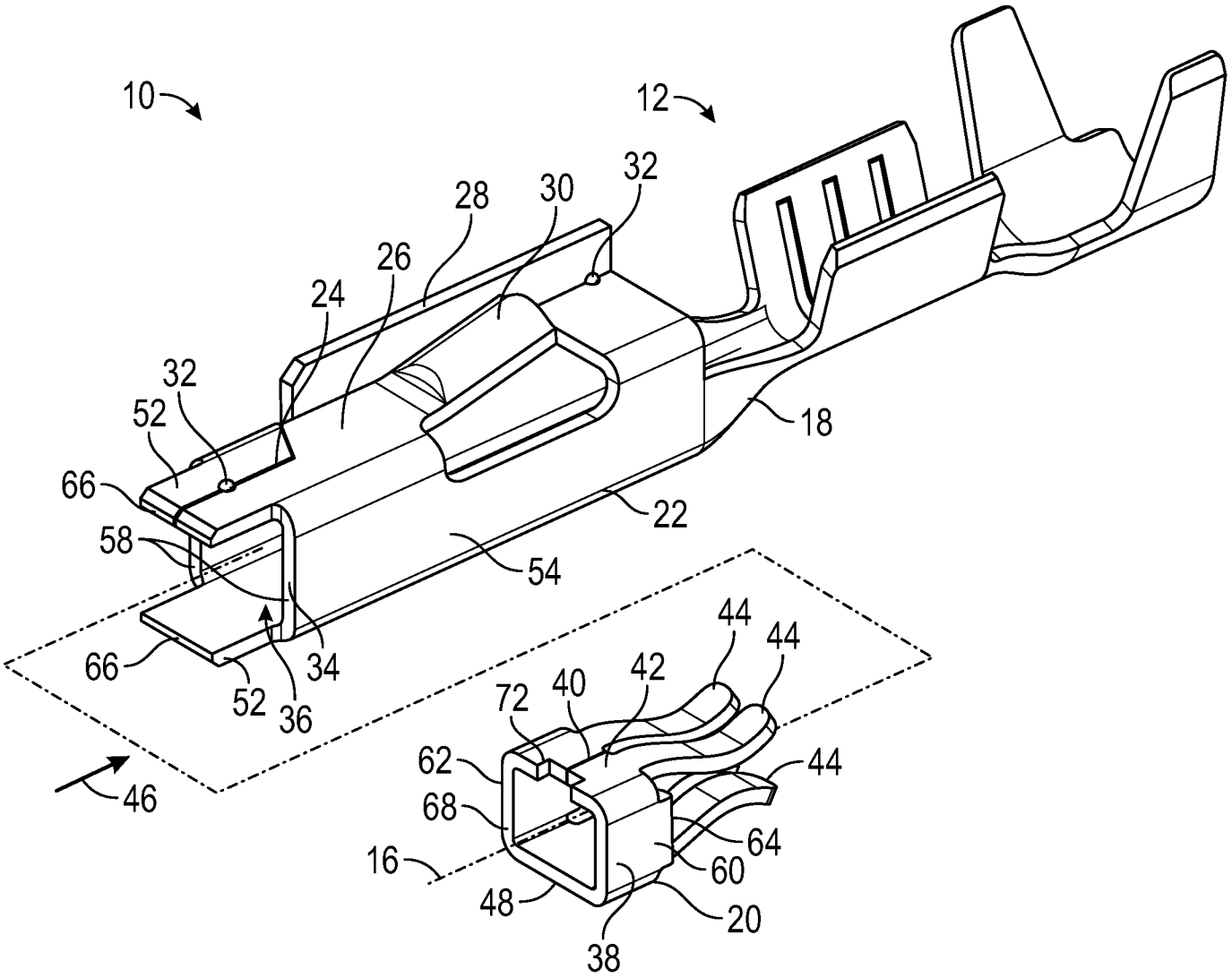
FIG. 2 is an exploded perspective view of the female electrical terminal of FIG. 1.

The female electrical terminal 10 is made of two pieces and includes an attachment piece 18 and a contact piece 20. Referring to FIG. 2 there is illustrated an exploded view of the female electrical terminal 10, with the attachment piece 18 and the contact piece 20 shown separate from each other.

The attachment piece 18 is made from a piece of sheet metal that is stamped and folded into the illustrated shape. However, the attachment piece 18 may be made of any desired material and by any desired process. The attachment piece 18 includes a terminal body 22. The illustrated terminal body 22 has a four-sided box cross-sectional shape located around the terminal axis 16. However, the terminal body 22 may have any desired shape. In the illustrated embodiment, the connection portion 12 and the terminal body 22 are both part of the attachment piece 18 and are made from a single piece of material. However, the connection portion 12 and the terminal body 22 may be separate pieces, if desired.

The terminal body 22 includes a body seam 24 that is located on a first body side 26. The body seam 24 is a location where edges of the sheet metal folded to create the attachment piece 18 meet. A polarizing projection 28 extends from the first body side 26 of the terminal body 22. The polarizing projection 28 is adapted to limit the orientations at which the female electric terminal 10 may be inserted into a housing (not shown). A lock lance 30 also extends from the first body side 26 of the terminal body 22. The lock lance 30 is cut from the first body side 26 and is adapted to retain the female electric terminal 10 in the housing. The illustrated polarizing projection 28 and the illustrated lock lance 30 extend from the first body side 26 of the terminal body 22, but may be in any desired location on the female electric terminal 10.

The illustrated terminal body 22 is retained in the illustrated shape by two body welds 32. However, the terminal body 22 may include any desired type of retaining feature. In the illustrated embodiment, one body weld 32 is located on the first body side 26 on the body seam 24, and the other body weld 32 is located on the first body side 26 and the polarizing projection 28. However, the body welds 32 may be in any desired locations.

The terminal body 22 includes a contact end 34 that is open to an interior space, indicated generally at 36, of the terminal body 22. The terminal axis 16 passes through the contact end 34. In the illustrated embodiment, the connection portion 12 extends from the terminal body 22 at the opposite side from the contact end 34, but the connection portion 12 may have any desired orientation.

The contact piece 20 is made from a piece of sheet metal that is stamped and folded into the illustrated shape. However, the contact piece 20 may be made of any desired material and by any desired process. The contact piece 20 includes a contact body 38. The illustrated contact body 38 has a four-sided box cross-sectional shape located around the terminal axis 16. However, the contact body 38 may have any desired shape.

The contact body 38 includes a contact seam 40 that is located on a first contact side 42 of the contact body 38. The contact seam 40 is a location where edges of the sheet metal folded to create the contact piece 20 meet. A plurality of contact arms 44 extend from the contact body 38 substantially in a mate direction 46. The illustrated contact piece 20 includes four contact arms 44, but may include any desired number of contact arms 44. The contact arms 44 engage the corresponding terminal when the female electrical terminal 10 is mated with the corresponding terminal. The contact arms 44 extend from the first contact side 42 and a second contact side 48. The second contact side 48 is located on the opposite side of the terminal axis 16 from the first contact side 42, and the contact arms 44 are arranged on opposed sides of the terminal axis 16. However, the contact arms 44 may be located on any desired part of the contact piece 20.

Figure 3:
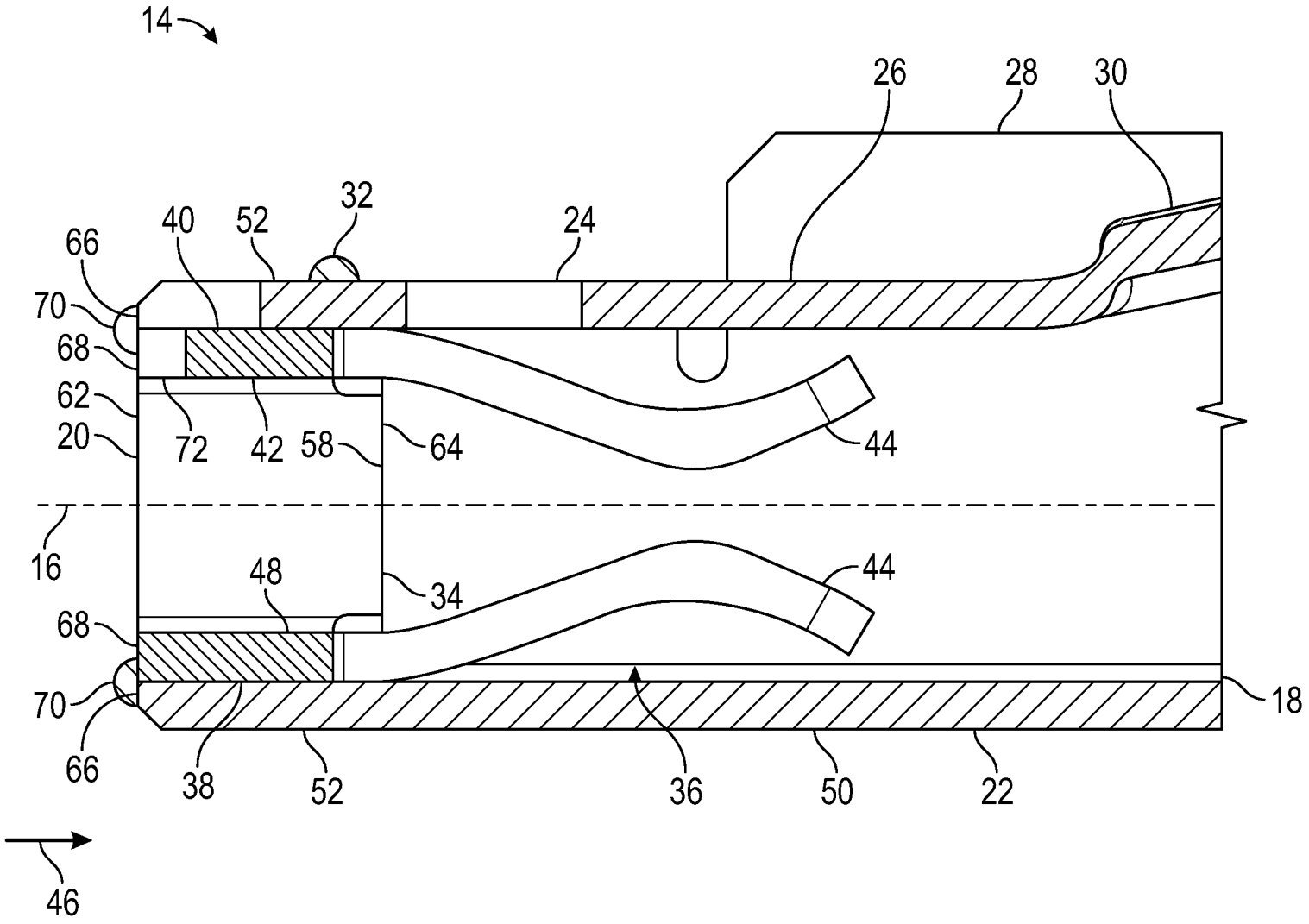
FIG. 3 is a cross-sectional view taken along the line 3-3 of FIG. 1.
Figure 4:
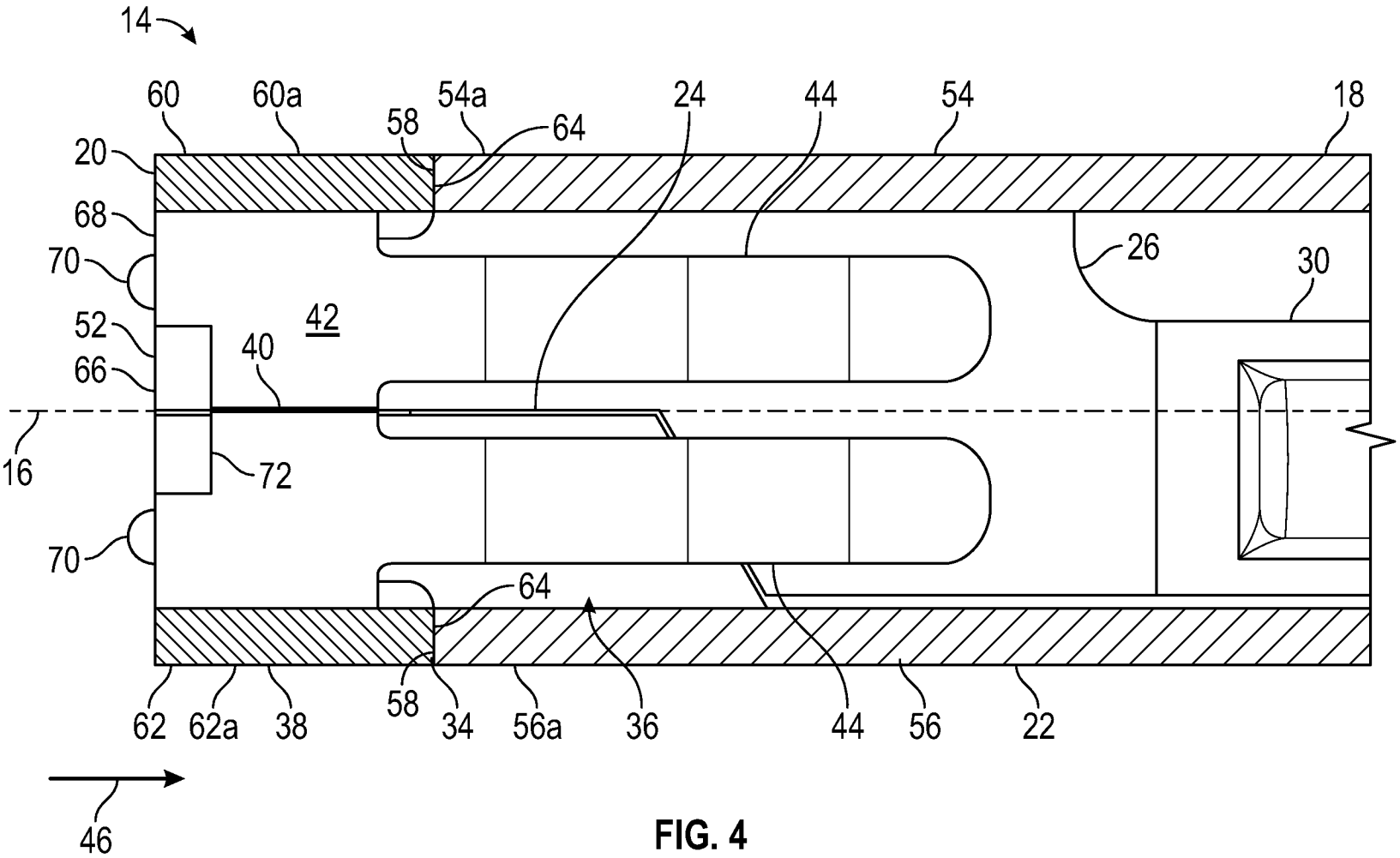
FIG. 4 is a cross-sectional view taken along the line 4-4 of FIG. 1.

Referring back to FIG. 1, when the female electrical terminal 10 is assembled, the contact piece 20 is located adjacent to the contact end 34 of the terminal body 22. FIGS. 3 and 4 illustrate cross-sectional views taken along the respective lines 3-3 and 4-4 of FIG. 1. When the female electrical terminal 10 is assembled, the contact arms 44 extend through the contact end 34 and are located at least partially in the interior space 36 of the terminal body 22.

The terminal body 22 includes a second body side 50 is located on the opposite side of the terminal axis 16 from the first body side 26. The first body side 26 and the second body side 50 each include a flange 52 that extends from the terminal body 22 opposite the mate direction 46. The first contact side 42 and the second contact side 48 are each located adjacent to one of the flanges 52. As best seen in FIG. 3, the flanges 52 are located on opposed sides of the contact body 38, and the first contact side 42 and the second contact side 48 are located between the flanges 52. When the female electrical terminal 10 is mated with the corresponding terminal, the contact arms 44 are pushed away from the terminal axis 16. The flanges 52 located outside the contact body 38 resist outward movement of the first contact side 42 and the second contact side 48 and help resist deformation of the contact body 38.

As previously described, the body seam 24 is located on the first body side 26 of the terminal body 22. The illustrated body seam 24 extends substantially parallel to the terminal axis 16 through the flange 52 that extends from the first body side 26. Additionally, the contact seam 40 is located on the first contact side 42, and the illustrated contact seam 40 also extends substantially parallel to terminal axis 16. As best shown in FIG. 4, the body seam 24 is substantially adjacent to the contact seam 40. The body weld 32 on the body seam 24 (which retains the shape of the terminal body 22) also retains the shape of the contact body 38 and helps prevent the contact body 38 from opening at the contact seam 40. It should be appreciated that the body seam 24 and the contact seam 40 may be in different positions from those illustrated and may have different relative orientations, if desired.

As best shown in FIG. 4, the terminal body 22 includes a third body side 54 and a fourth body side 56 that are located on the opposed sides of the terminal axis 16. The third body side 54 and the fourth body side 56 are each connected to both the first body side 26 and the second body side 50. Each of the third body side 54 and the fourth body side 56 includes a respective body stop 58 located at an end opposite the mate direction 46. Additionally, the contact body 38 includes a third contact side 60 and a fourth contact side 62 that are located on the opposite side of the terminal axis 16. The third contact side 60 and the fourth contact side 62 are each connected to both the first contact side 42 and the second contact side 48. Each of the third contact side 60 and the fourth contact side 62 includes a respective contact stop 64 located at an end in the mate direction 46. When the female electrical terminal 10 is assembled, the contact stops 64 engage the body stops 58 to prevent movement of the contact piece 20 in the mate direction 46 relative to the attachment piece 18.

As best shown in FIG. 3, each flange 52 extends opposite the mate direction 46 to a respective flange end 66. Also, the first contact side 42 and the second contact side 48 extend to respective contact ends 68. Each flange end 66 is substantially even with the adjacent contact end 68. In the illustrated embodiment, the contact body 38 has uniform contact ends 68 on the first contact side 42 and the second contact side 48, but the contact ends 68 may be offset from each other, if desired. Contact welds 70 are applied to the flange end 66 and the adjacent contact end 68 to retain the attachment piece 18 in position relative to the contact piece 20. The illustrated contact welds 70 are applied opposite the mate direction 46 of the contact piece 20. As best shown in FIG. 1, the illustrated embodiment includes three contact welds 70. However, the female electrical terminal 10 may include any desired number of contact welds 70 in any desired locations.

Referring back to FIG. 4, the third body side 54 includes an outer surface 54*a* that is substantially even with an outer surface 60*a* of the third contact side 60. Similarly, the fourth body side 56 includes an outer surface 56*a* that is substantially even with an outer surface 62*a* of the fourth contact side 62. This provides the illustrated female electrical terminal 10 with a substantially uniform outside dimensions along the terminal axis 16 in the location of the body stops 58. However, the outer surfaces 54*a*, 56*a*, 60*a*, and 62*a* may be in any desired relative positions.

The contact piece 20 includes an indent 72 that is located in the contact end 68 of the first contact side 42. The indent 72 extends from the contact end 68 in the mate direction 46. In the illustrated embodiment, the contact seam 40 extends into the indent 72. The indent 72 allows for the insertion of a tool (not shown) below the flange 52 during assembly of the female electrical terminal 10.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A female electrical terminal comprising:

an attachment piece including a terminal body that defines a terminal axis and an interior space, the terminal body including a plurality of flanges located on opposed sides of the terminal axis and one or more body stops; and a contact piece including a contact body that is located around the terminal axis and a plurality of contact arms that extend from the contact body at least partially into the interior space, the contact body being located at least partially between two of the plurality of flanges and the terminal axis, the contact piece including one or more contact stops respectively engaged with the one or more body stops, wherein either:

the female electrical terminal further includes one or more contact welds between the attachment piece and the contact piece; or the terminal body includes (1) a first body side and a second body side located on opposite sides of the terminal axis, and (2) a third body side and a fourth body side located on opposite sides of the terminal axis, wherein:

(a) a first one of the flanges extends from the first body side, (b) a second one of the flanges extends from the second body side, (c) a first one of the body stops is located on the third body side, (d) a second one of the body stops is located on the fourth body side, and (e) a body seam is provided on the first body side, and the first one of the flanges extends from the first body side.

2. The female electrical terminal of claim 1, further including one or more contact welds between the attachment piece and the contact piece.

3. The female electrical terminal of claim 2, wherein the one or more contact welds are located on the flanges.

4. The female electrical terminal of claim 1, wherein the terminal body includes (1) a first body side and a second body side located on opposite sides of the terminal axis, and (2) a third body side and a fourth body side located on opposite sides of the terminal axis, wherein: (a) a first one of the flanges extends from the first body side, (b) a second one of the flanges extends from the second body side, (c) a first one of the body stops is located on the third body side, (d) a second one of the body stops is located on the fourth body side; and (e) a body seam is provided on the first body side and the first one of the flanges that extends from the first body side.

5. The female electrical terminal of claim 4, wherein the contact body includes (1) a first contact side and a second contact side located on opposite sides of the terminal axis, and (2) a third contact side and a fourth contact side located on opposite sides of the terminal axis, wherein: (a) a first one of the contact arms extends from the first contact side, (b) a second one of the contact arms extends from the second contact side, (c) a first one of the contact stops is provided on the third contact side, and (d) a second one of the contact stops is provided on the fourth contact side.

6. The female electrical terminal of claim 5, wherein the first contact side is located between the first one of the flanges and the terminal axis, and the second contact side is located between the second one of the flanges and the terminal axis.

7. The female electrical terminal of claim 6, including a contact seam on the first contact side.

8. The female electrical terminal of claim 7, including an indent that extends from a contact end of the contact body, wherein the terminal seam extends to the indent.

9. The female electrical terminal of claim 8, including one or more contact welds between the attachment piece and the contact piece.

10. The female electrical terminal of claim 8, including one or more contact welds between the flanges and the contact piece.

11. The female electrical terminal of claim 1, wherein the terminal body has a four-sided box cross-sectional shape.

12. A female electrical terminal comprising:

an attachment piece including a terminal body that defines an interior space and includes a first body side and a second body side located on opposite sides of a terminal axis, and a third body side and a fourth body side located on opposite sides of the terminal axis and connected to the first body side and the second body side, the terminal body including a plurality of flanges extending from the first body side and the second body side and a plurality of body stops located on the third body side and the fourth body side; and a contact piece including a contact body that includes a first contact side located adjacent to the flanges that extend from the first body side, a second contact side located adjacent to the flanges that extend from the second body side, a plurality of contact arms extending from the first contact side and the second contact side into the interior space, and a third contact side and a fourth contact side connected to the first contact side and the second contact side and including a plurality of contact stops that are engaged with the body stops;

wherein one or more contact welds is provided on the flanges and the contact body.

13. The female electrical terminal of claim 12, wherein the terminal body has a four-sided box cross-sectional shape.

14. A female electrical terminal comprising:

an attachment piece including a terminal body having an interior space, first and second flanges extending from the terminal body, and a body stop; and a contact piece disposed within the interior space of the attachment piece and including a contact body having first and second contact arms that extend from the contact body and a contact stop that is engaged with the body stop, wherein either:

(1) a contact weld is provided between the first flange of the attachment piece and the contact body of the contact piece; or (2) a plurality of contact welds is provided between both of the first and second flanges of the attachment piece and the contact body of the contact piece; or (3) the terminal body includes a body side having a body seam, the first flange extends from the body side of the terminal body, and a contact weld is provided between the first flange of the attachment piece and the contact body of the contact piece.

15. The female electrical terminal of claim 14 wherein a contact weld is provided between the first flange of the attachment piece and the contact body of the contact piece.

16. The female electrical terminal of claim 14 wherein a plurality of contact welds is provided between both of the first and second flanges of the attachment piece and the contact body of the contact piece.

17. The female electrical terminal of claim 14 wherein the terminal body includes a body side having a body seam, the first flange extends from the body side of the terminal body, and a contact weld is provided between the first flange of the attachment piece and the contact body of the contact piece.

18. The female electrical terminal of claim 14, wherein:

(1) a contact weld is provided between the first flange of the attachment piece and the contact body of the contact piece; and (3) the terminal body includes a body side having a body seam, and the first flange extends from the body side of the terminal body.

19. The female electrical terminal of claim 14, wherein:

(2) a plurality of contact welds is provided between both of the first and second flanges of the attachment piece and the contact body of the contact piece; and (3) the terminal body includes a body side having a body seam, and the first flange extends from the body side of the terminal body.

20. The female electrical terminal of claim 14, wherein the terminal body has a four-sided box cross-sectional shape.

* * * * *